United States Patent [19]

Bash

[11] 4,233,953

[45] Nov. 18, 1980

[54] PROPULSION DEVICE FOR TENNIS BALLS AND LIKE SPHERICAL OBJECTS HAVING AN IMPROVED PROGRAMMED DISCHARGE OF THE OSCILLATORY TYPE

[75] Inventor: C. Malcolm Bash, Trenton, N.J.

[73] Assignee: Prince Manufacturing Co., Inc., Princeton, N.J.

[21] Appl. No.: 955,852

[22] Filed: Oct. 30, 1978

[51] Int. Cl.[3] ..... F41F 1/04; A63B 69/38

[52] U.S. Cl. ..... 124/56; 74/48; 273/29 A

[58] Field of Search ..... 124/6, 7, 8, 9, 56, 124/71, 72, 78; 273/26 D, 29 A, 30; 74/48

[56] References Cited

U.S. PATENT DOCUMENTS

| | | | |
|---|---|---|---|
| 1,495,218 | 5/1924 | Allen | 74/48 X |
| 3,018,769 | 1/1962 | Parsoneault | 124/56 |
| 3,757,759 | 9/1973 | Haworth | 124/7 |
| 3,807,379 | 4/1974 | Vodinh | 124/26 D |
| 3,855,988 | 12/1974 | Sweeton | 124/56 |
| 3,915,143 | 10/1975 | Waller | 124/75 |
| 3,930,486 | 1/1976 | Kahelin | 124/75 |
| 3,989,245 | 11/1976 | Augustine, Jr. et al. | 273/29 A |
| 4,002,336 | 1/1977 | Beaver et al. | 273/30 |
| 4,027,646 | 6/1977 | Sweeton | 124/56 |
| 4,046,131 | 9/1977 | Clark et al. | 124/71 |
| 4,086,903 | 5/1978 | Scott | 124/78 |
| 4,094,294 | 6/1978 | Speer | 124/56 |
| 4,140,097 | 2/1979 | Lewis | 124/9 X |

FOREIGN PATENT DOCUMENTS

| | | | |
|---|---|---|---|
| 2338716 | 8/1977 | France | 124/56 |

*Primary Examiner*—Richard T. Stouffer

*Attorney, Agent, or Firm*—Frederick A. Zoda; John J. Kane; Albert Sperry

[57] ABSTRACT

A device for propelling tennis balls has an oscillating discharge barrel to which balls are fed from a rotating distributor. A programmed relationship is provided, including a motion-translating linkage oscillating the barrel as an extension of the mechanism used for rotating the distributor. Programming is achieved to cause a predetermined number of objects to be propelled from the barrel, during each oscillatory cycle, as a direct response to rotation of the distributor.

The linkage can be optionally provided without changing the basic design of propulsion devices heretofore made. The invention provides this through an extension shaft of the distributor, which rotates a member having openings spaced different radial distances from the axis of rotation of the member. A drop pin is extendable through any of the openings, and through a slot of a motion-translating link connected to a support bracket for the barrel. Vertical adjustment of the barrel, selective adjustment of its angular travel, selective blocking out of distributor feed openings, and a selected drive ratio between the distributor and the motion-translating means combine to effect a wide range of discharge programs. Further variation is achieved by selecting various angular relationships between openings of the motion-translating member, and openings of the distributor.

12 Claims, 10 Drawing Figures

Fig. 1.
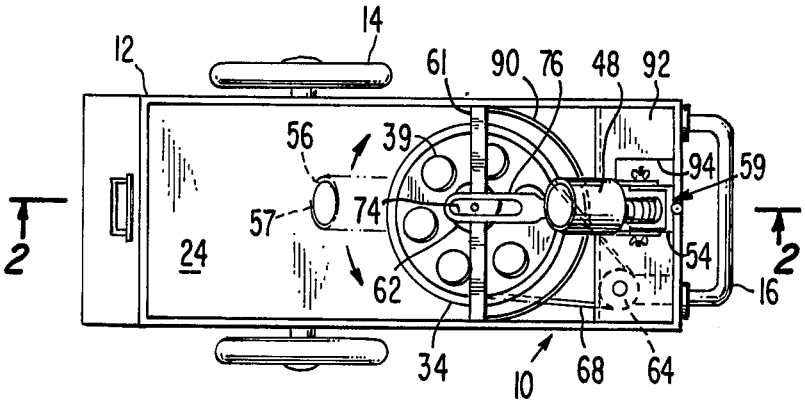
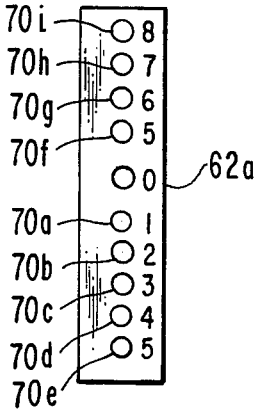
Fig. 9
Fig. 3.
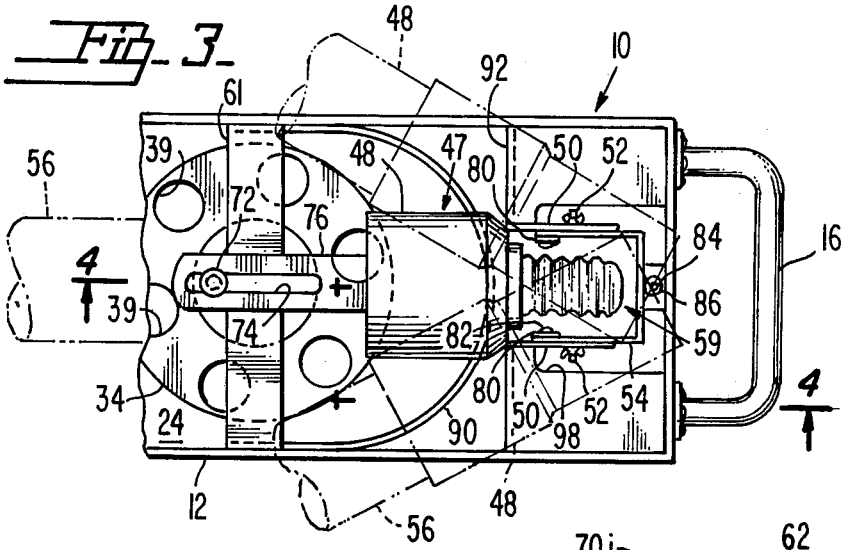
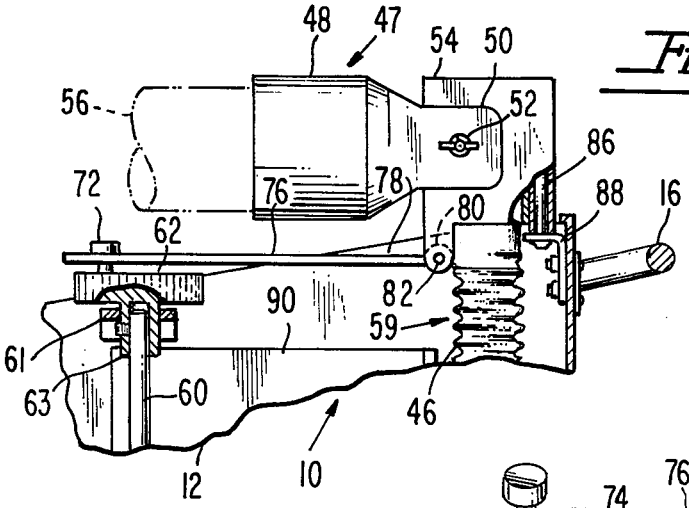
Fig. 4.
Fig. 5.
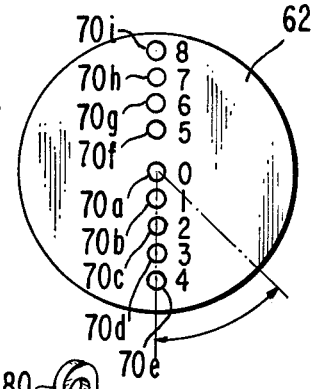
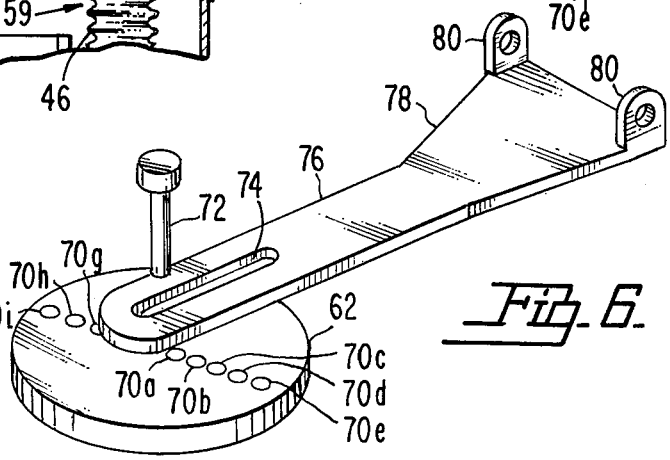
Fig. 6.

PROPULSION DEVICE FOR TENNIS BALLS AND LIKE SPHERICAL OBJECTS HAVING AN IMPROVED PROGRAMMED DISCHARGE OF THE OSCILLATORY TYPE

BACKGROUND OF THE INVENTION

1. Field of the Invention

The invention relates generally to devices that propel forcibly into the air spherical objects such as tennis balls or the like for practice or training purposes. In a more particular sense, the invention relates to means for imparting oscillatory motion to the discharge barrel of a propulsion device of the type stated about an axis that, if not completely vertical, has at least a vertical component. The invention is directed to a programming-type improvement in the means for creating oscillating motion of the discharge barrel whereby to time the oscillation and the extent of angular travel thereof in relation to the successive discharge of the balls during the normal rotation of the distributor or feed magazine.

2. Description of the Prior Art

Tennis ball propulsion devices, for use as training aids, are of course very well known. A typical propulsion device of the type stated may be seen in U.S. Pat. No. 4,027,646 issued June 7, 1977. In such devices, there is a hopper, a rotary feed magazine or distributor having a plurality of angularly spaced ball-receiving openings or sleeves, and a conduit that extends from the distributor location to the outlet of the device. Passage of a ball from the distributor through said conduit occurs within a pressurizing chamber, in such fashion that the balls are successively fed through the conduit. Pressure is built up behind each of them, until the pressure reaches a value such as to cause the ball to be forcibly discharged.

In the prior art, various means have heretofore been devised for changing or varying the path in which the successively propelled objects will be directed. It is known, for example, to cause the discharge barrel of such a device to be oscillated, that is, moved in a continuous back-and-forth or side-to-side motion, so that the user will be required to run back-and-forth across the tennis court, to return each ball, thereby to obtain practice in executing forehand as well as backhand strokes, increase his or her stamina, and otherwise obtain added benefits from the use of the propulsion device. See for example, Sweeton et al U.S. Pat. No. 4,006,726 issued to the assignee of the present application, and the patents cited therein.

The prior art devices have been effective in respect to achieving the broad objects of varying the paths along which the tennis balls or other spherical objects are discharged. However, the prior art has had certain disadvantages, including, for example, the provision of oscillatory motion only through the medium of expensive electrical, electronic, or complex mechanical devices.

Further, in the prior art such devices have in many instances been required to be built into the complete device, in such fashion that the user would be prevented from manufacturing, with the same components, both standard and programmed oscillating type discharge mechanisms.

In still other prior art devices, it has not been possible for a user to adjust, with maximum speed and ease, the width of the oscillating path in which the discharge end of the barrel is to travel. And in yet other cases the user is prevented from disengaging the oscillating mechanism except with considerable difficulty.

Thus, the prior art has broadly suggested the concept of timing oscillation of a discharge barrel in relation to the feeding of balls into the propulsion device, but heretofore, so far as is known, the prior art has not suggested a mechanical linkage between the ball feeding and the discharge mechanisms, such as to optionally connect or disconnect the oscillation-producing means, adjust swiftly and easily the extent of oscillating travel in relation to the quantum and frequency of ball delivery, and, in general, facilitate the manufacture of propulsion devices of this type so as to incorporate an oscillating mechanism that is inexpensive, simple, and trouble free, and that can be either incorporated in or left out of the propulsion device, according to the desires of the manufacturer and without changing in either instance the design or assembly of the basic propulsion device.

SUMMARY OF THE INVENTION

Summarized briefly, the improvement comprising the present invention is incorporated in a propulsion device of basically known or conventional design and construction. Such devices include a portable housing, containing a pressurizing chamber and a ball feed hopper. A rotary distributor has a series of angularly spaced ball-receiving sleeves, through which the balls pass from the hopper. As the distributor rotates, it passes over a feed opening extending into the pressurizing chamber, so that the balls are successively delivered from the distributor or magazine into the chamber. Within the pressurizing chamber, they are directed in following order into a receiver, for subsequent discharge through the barrel. Means are provided within the discharge path to temporarily arrest each ball, in a sealable fashion, so as to cause pressure to build up within the pressurizing chamber. When the pressure reaches a predetermined value, the ball is forcibly moved past the arresting device or means, and is discharged under pressure from the barrel.

The improved device constituting the present invention incorporates a shaft extension projecting upwardly from the distributor. Secured to the upper end of the extension is a member, having a plurality of openings spaced different radial distances from the axis of rotation of the member.

An elongated link has a distal end overlying the member, this end of the link being formed with a longitudinal slot. A drop pin is removably positioned through the slot, to engage in any opening of the member selected by the user. The other end of the link is connected to a barrel support bracket, which is pivotally mounted upon the housing of the device for swinging movement about an axis which, if not completely vertical, at least has a vertical component. By selecting a particular opening of the member for insertion of the drop pin, the range of oscillatory motion of the barrel support bracket, and hence of the barrel itself, is adjusted. In other words, the closer the selected opening to the axis of member rotation, the narrower the width of the oscillatory cycle of the barrel. The entire oscillating mechanism can be disconnected merely by removing the drop pin or locating it in an opening of the member coincident with its axis of rotation. If it is desired to manufacture the device without the oscillating mechanism, one may simply leave off the extension shaft, member, and link, while maintaining the barrel support bracket against pivotal movement.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

FIG. 1 is a top plan view of a ball propulsion device incorporating the improvement that comprises the present invention;

FIG. 3 is an enlarged, fragmentary top plan view of the device as seen from the line 3—3 of FIG. 2, the chain dotted lines indicating three different positions to which the barrel moves during its oscillatory travel;

FIG. 4 is a fragmentary, longitudinal sectional view substantially on line 4—4 of FIG. 3, on the same scale as FIG. 3;

FIG. 5 is a still further enlarged, top plan view of the motion translating rotary member, per se;

FIG. 6 is a still further enlarged, exploded perspective view of the motion translating mechanism or linkage, per se;

FIG. 9 is a top plan view of a modified form of rotary member capable of being substituted for that illustrated in FIG. 5.

DETAILED DESCRIPTION OF THE PREFERRED EMBODIMENT

Figure 2:
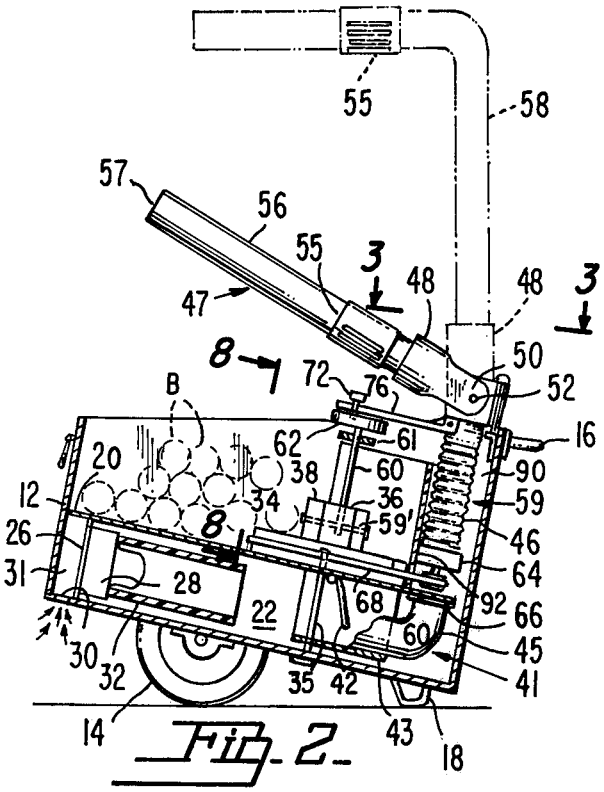
FIG. 2 is a longitudinal, vertical section through the device, taken substantially on line 2—2 of FIG. 1, the chain dotted and dashed lines indicating alternative barrel positions and barrel types.

Referring to the drawing in detail, the reference numeral 10 has been generally applied to a ball propulsion machine or device having the improvement comprising the present invention.

A machine of this type, conventionally, includes a hollow housing or support frame 12. This may be wheeled as at 14. It may have a handle 16 to facilitate movement to a desired location, and may be provided with a skid or frame member 18 providing a stable support for the device when in use. When in use, the device appears as in FIG. 2.

The machine conventionally includes a divider 20. This separates the machine into a pressurizing chamber 22 and an upwardly opening hopper 24 for tennis balls B or other spherical objects to be propelled.

Within the pressurizing chamber, there is provided a transverse partition 26 near the forward end of the chamber. Mounted upon the partition is a blower 28 extending rearwardly within the pressurizing chamber 22. An air inlet 30 is disposed in communication with an air intake chamber 31. Chamber 31 is defined between the partition 26 and the front wall of the housing 12. Air entering through the opening 30 is drawn by the blower 28 into the pressurizing chamber, and is discharged toward the rear end of the chamber through the provision of a large diameter blower outlet tube 32. Tube 32 may as illustrated be mounted directly upon the blower within the pressurizing chamber.

A rotary, generally flat, circular distributor or magazine 34 is provided. Distributor 34 is mounted at the bottom of the feed hopper directly above the divider 20. The distributor is mounted for rotation upon a shaft 35 supported in the housing and extending through divider 20. The distributor may be integral or is otherwise made rotatable with an upstanding projection or boss 36 of cylindrical form. Boss 36 has a plurality of angularly and uniformly spaced radially projecting agitator ribs 38. These serve to prevent "bridging" of the tennis balls above the distributor. They assure that the several angularly spaced ball-receiving distributor sleeves or openings 39 will be filled with the tennis balls as the distributor rotates.

The distributor 34, when rotated, causes each ball that has been deposited in a sleeve 39, to move into position above a ball feed opening 40 formed in the divider 20. As a result, as each sleeve 39 registers with the divider opening 40, the ball drops through the opening 40. The ball impels a closure or hinged trap door 42 to a temporarily opened position (see FIG. 2). Normally, the trap door is closed by the pressure of air within the chamber 22. The ball drops into a channel-shaped ramp 43 and from there moves into the inlet end of a tubular receiver 44. Receiver 44 at its lower end has an approximately L-shaped rigidly constituted discharge tube 45. The inlet end of tube 45 receives each ball that drops through the opening 40. The tube 45 extends upwardly into communication with a flexible discharge tube 46. This constitutes an extension of tube 45. It extends upwardly within the rear end of the housing above the pressurizing chamber into communication with a barrel means generally designated 47. Barrel means 47 includes a discharge barrel mounting sleeve 48. Any of various barrels or extensions thereof may be connected to the sleeve 48

The discharge barrel mounting sleeve 48 includes at its rear end a pair of transversely spaced, rearwardly projecting, identical but opposite support plates 50. Plates 50 have transversely aligned apertures receiving a connecting pin 52. Pin 52 serves to pivotally mount the barrel mounting sleeve upon a U-shaped support bracket 54. Pin 52 mounts the barrel mounting sleeve 48 for adjustment about a horizontal axis. For example, the sleeve 48 may be adjusted between the full and dotted line positions shown in FIG. 2. In this way the angle at which the balls are discharged can be varied as desired. One may for example desire that the balls be propelled upwardly at a steep angle. This simulates a lob, and the user can practice the return of shots of this type. Or, the barrel can be lowered so as to cause the trajectory of the ball to assume a more nearly horizontal angle. This simulates a low driving return.

To adjust the speed at which the ball is discharged, it is preferred to use a velocity control sleeve 55. This has apertures that can be closed, or opened to a selected size. The adjustment is effected by rotation of sleeve 55.

One can use any of various barrels. For example a straight barrel 56 can be attached to the sleeve 48. Barrel 56 has a discharge end 57 which as indicated above can be pointed to discharge the ball at any desired angle relative to the horizontal. Or, the sleeve 48 could be adjusted to a fully vertical position as in the dotted line showing of FIG. 2. There can be used in this event an inverted L-shaped barrel 58 curved through 90°. This discharges the balls at a high elevation, simulating serves or deep overhand smashes.

It may thus be noted that a discharge conduit generally designated 59 is defined. This begins at the point at which the distributor feeds the balls into the pressurizing chamber. It ends at the discharge end 57. The conduit thus includes the ball feed opening 40, the ramp 43, the rigid discharge tube 45, the flexible discharge tube 46, the discharge barrel mounting sleeve 48, and the barrel 56 or 58.

All of the above is conventional. It represents the same basic organization and construction of parts disclosed in U.S. Pat. No. 4,027,646. As in that patent there would be provided of course a temporary ball arresting means (not shown) within the conduit. This momentarily engages each ball, until pressure is built up behind the ball sufficiently to cause it to be forcibly discharged from the barrel. It may be considered that the ball arresting means is incorporated in this disclosure by reference to U.S. Pat. No. 4,027,646.

Figure 8:
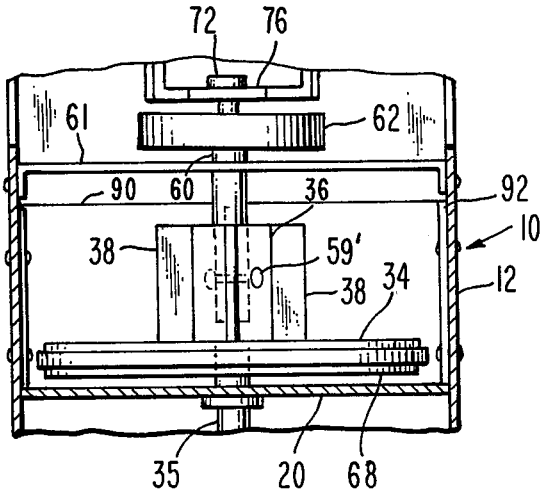
FIG. 8 is a transverse, vertical sectional view on the same scale as FIGS. 3 and 4, taken substantially on line 8—8 of FIG. 2.

The improvement comprised in the present invention utilizes an upwardly projecting extension shaft 60. This may be detachably connected to the rotor 34 in any suitable fashion in coaxial alignment with shaft 35. For example it may be connected to the upstanding projection 36 of the rotor or distributor 34 by means of a cross pin 59' as shown in FIGS. 2 and 8. A cross brace 61 supports the upper end of extension 60.

Referring to FIGS. 3–6, a rotary member, which by way of illustration is depicted as a flat disc 62, is keyed to or otherwise made rotatable with the shaft extension 60. In the illustrated example the distributor 34 and the disc 62 have a one-to-one driving ratio. However, this is not essential. There could if desired be a geared connection between the distributor and the disc. Or some other type of change ratio mechanism could be used to obtain a different driving ratio. For example it may be desired that the disc 62 make two rotational cycles for each single cycle of the distributor.

Referring to FIG. 4, a socket 63 on the member 62 receives extension 60. A set screw is threadedly engaged in the side wall of the socket. It bears against extension 60 so that the member 62 and the extension 60 are engaged for joint rotation.

This arrangement also permits angular adjustment of the member 62 in respect to the distributor. An adjustment of 30° changes significantly the location at which the tennis balls will be discharged during each oscillating cycle.

Referring to FIG. 2, mounted in the housing at the rear end thereof is a gear reduction motor 64. This has a driving pulley 66 about which is trained a drive belt 68. Belt 68 extends about and drives the distributor 34 and hence the disc 62.

Referring to FIG. 5, formed in the disc 62 is a radial series of openings or apertures 70*a*, 70*b*, 70*c*, 70*d*, 70*e*. All of these openings are spaced at different radial distances from the axis of rotation of the shaft 62. There could obviously be still more openings. This would increase the adjustments possible in use of the invention. For example, there can be openings 70*f*, 70*g*, 70*h*, and 70*i* of a second series. These occur at radial distances from the center that are staggered in respect to the openings of the first series. All the openings can be numbered 1, 2, 3, etc. This facilitates the following of printed instructions.

Instead of a disc there could be secured to the extension shaft 60 a radial or diametrically extending bar 62*a* (see FIG. 9) having the several openings formed therein. It is mainly important that the rotary member 62 be driven by the shaft 60 simultaneously with rotation of the distributor. Also, it must have one or more openings radially spaced from the axis of rotation. A circular outer shape of the member 62 is not essential to successful use of the device.

The improvement comprised in the present invention further includes (see FIGS. 4–6) a drop pin 72. This is removably insertable through an elongated longitudinal slot 74. The slot is formed in the distal end of a flat link 76. The link extends rearwardly from the member 62. At its proximal end it has a progressively widened tongue 78. The tongue terminates in upwardly projecting and transversely aligned, apertured ears 80. The ears are embraced by the sidewalls of the U-shaped bracket 54.

Referring to FIGS. 3 and 4, transversely extending connecting pins 82 extend through the respective ears 80. The pins also extend through bearing openings provided in the respective sidewalls of the bracket 54. The openings provide a pivotal connection of the link to the bracket. Thus the link can if necessary swing upwardly and downwardly relative to the bracket or vice versa. It is mainly important to note that when the link is connected to the bracket, the link and support bracket will oscillate as one. They move about a pivot axis defined by a hinge pin 84 extending through a hinge sleeve 86. Sleeve 86 is affixed to the back wall of the U-shaped bracket 54. Pin 84 is mounted upon the housing in any suitable fashion. For example, the lower end of the pin may be welded to a support bracket of inverted L shape 88 secured to the back wall of the housing (see FIG. 4).

On each rotation of the disc or equivalent member 62 with the drop pin 72 engaged in a selected one of the openings of the member 62, the link 76 and hence the support bracket will be operated through a single cycle of oscillatory movement. The support bracket will thus be caused to move from one side to the other and back again.

In a single oscillation of the bracket the barrel may be caused to move between the left and right hand extreme positions shown in chain dotted outline in FIG. 3.

Assume for example that the opening 70*a* is closest in the radial sense to the axis of rotation of member 62. The width of the oscillatory cycle will be at its narrowest when this opening is used. Conversely the width of the path of oscillation can be progressively increased. This is achieved by using openings of member 62 that are spaced progressively greater radial distances from the axis of rotation of the shaft extension 60.

The member 62 or 62*a* may include a radially extending slot, not shown. In this case the openings 70*a*, etc., would be provided in the link 76. This would be a pure reversal of parts that would not affect in any way the successful use of the device.

It is desirable to keep the back end of the hopper clear. This assures to the maximum extent against interference with the driving mechanism defined by the motor 64 and belt 68. There is provided in the present instance a semi-circular back plate 90. This extends across the rear end portion of the hopper. In back of the plate 90 there is a motor cover plate 92. Formed in the plate 92 is a recess 94 (see FIG. 1) accommodating the tube 46.

Figure 7B:
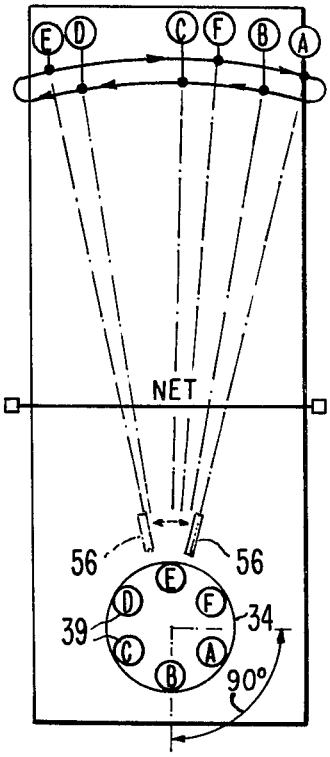
FIGS. 7*a* and 7*b* are diagrammatic representations of a practice area, illustrating the device as it appears when in use.
Figure 7A:
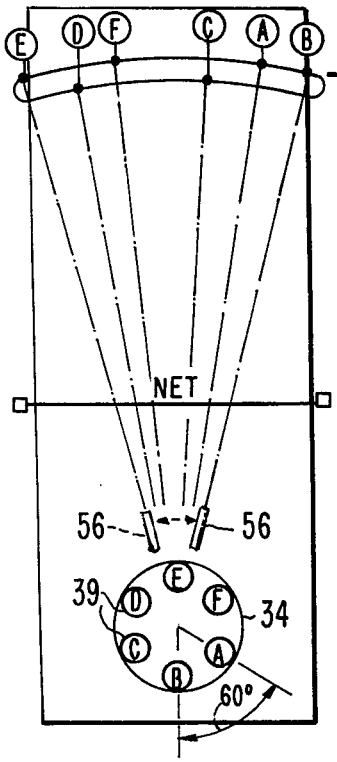

In use the device is positioned as shown in FIGS. 7*a* and 7*b*, in which the distributor is depicted schematically, at one side of a net stretched across a tennis court or other practice area. The barrel is adjusted about its horizontal axis defined by the pin 52. It is set at a selected position of vertical adjustment. Pins 52 may be equipped with thumb screws or equivalent means. These clamp the barrel in selected positions to which it is vertically adjusted.

The blower motor and the gear reduction motor 64 are placed in operation. The balls will now be fed in succession through the conduit 59. In the example illustrated each rotation of the distributor 34 will result in propulsion of six balls for each full oscillatory cycle of the barrel. This is shown in FIGS. *7a* and *7b*. Assume that all of the openings 39 of the distributor are left uncovered. Assume further that the distributor and the disc 62 are connected in a one-to-one driving ratio. The six tennis balls will be propelled at uniformly timed intervals to the locations A, B, C, D, E, and F (corresponding to similarly lettered ball feed sleeves 39 of the distributor as seen schematically in FIGS. *7a* and *7b*) in a single oscillatory cycle. There is one cycle of oscillation for each 360° cycle of rotation of the distributor. The distributor in the given example has six ball receiving openings 39.

One can close off any one or more of the openings 39. This is disclosed in U.S. Pat. No. 4,027,646. If one were to close every other opening 39, only three balls will be propelled in a single cycle of oscillating motion of the barrel. In this event the balls might be propelled to the locations A, C, and E shown in FIGS. *7a* and *7b*.

It is also true that the barrel mounting means can be adjusted vertically. One can thus program the device for propelling balls lob-fashion. Again they would be delivered from side to side of the court. The player may thus practice returning lobs or delivering overhand smashes.

In combination with any of these arrangements, one can select any of the various openings of the member 62 or 62*a*. One may thus narrow or widen the area in which the balls will drop. One can also make the angular adjustment illustrated by the arrows in FIG. 5. This shows an adjustment of member 62 relative to the distributor 34, about their common rotational axis.

The angular adjustment shown in FIG. 5 could be any adjustment falling in a wide range of adjustments. Thus, in the disclosed form of the invention, the row of drop-pin-receiving openings 70*a*–70*i* of member 62 or 62*a* can be adjustably disposed anywhere from a location coincident with a particular sleeve 39, to a location in which the row of openings is offset a selected angular distance from said sleeve up to a maximum of 59°. At 60° the row of openings would coincide with the center of the next adjacent sleeve 39 so that it would in effect revert to its initial position.

The operational characteristics resulting from the FIG. 5 type of adjustment are illustrated in FIGS. *7a* and *7b*.

In FIG. *7a*, assume that the disc opening that receives the drop pin has been angularly offset 60° from the center of the sleeve 39 designated B, which for the sake of this example has been arbitrarily selected as a starting point on the distributor. This locates the pin receiving opening coincident with distributor sleeve A.

In FIG. *7b* the pin receiving opening has been offset another 30° from said starting point, so that it has now been offset 90° from sleeve B and 30° from sleeve A. Assuming that all other adjustments (for example the barrel elevation, or the selection of a particular one of the openings 70) remain constant, the ball drop pattern produced by oscillation of the barrel is thus seen to differ very materially in the angular adjustment represented by FIG. *7b* from that obtained in the adjustment schematically represented in FIG. *7a*. In both Figures, the locations at which the balls have been found to drop when the illustrated angular adjustment is used have been indicated by reference letters A, B, etc., corresponding to those of the ball feed sleeves 39.

There is thus disclosed a programmed ball discharge adjustable in a comparatively wide range. The user is thus enabled to practice a wide variety of shots. These may be at timed intervals selected according to his or her practice needs. One can indeed swiftly disconnect the oscillating mechanism. This is effected merely by removal of the drop pin 72. In these circumstances, the device would operate without oscillation of the barrel.

Also, the manufacturer can make propulsion devices either with or without the oscillating mechanism. This is done with a minimum change of parts. The manufacturer can simply leave off the link 76 and the disc 62. He may also leave off the extension shaft 60. In these circumstances it may be desired to anchor the bracket 54 against side-to-side motion about its pivot pin 84. In this event a set screw, not shown, may be mounted in the sleeve 86. This would be capable of being tightened against the pin 84. This would prevent undesired level deviation of the bracket 54 when the oscillating mechanism is disconnected.

Of particular importance is the fact that the distributor and the oscillating mechanism are connected for simultaneous driving from a single source of power. This permits adjustment of the oscillating mechanism to the timed delivery of the balls by the propulsion device.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. In a propulsion device for spherical objects, said device being of the type including a portable housing having propulsion means and a hopper for said objects, a rotary distributor adapted to feed a selected number of said objects in successively following order during each rotation of the distributor through a 360° cycle, a tubular receiver into which said objects are fed from the distributor, means for driving the distributor, barrel means communicating with the receiver and providing an outlet through which said objects are discharged by the propulsion means, and a support bracket for the barrel means, an improvement for programming cyclic oscillatory movements of the barrel means as a wholly mechanical function of the rotational cycles of the distributor, the improvement comprising:

(a) means mounting the support bracket upon the housing for oscillating movement about an axis having a vertical component; and (b) motion-translating means formed wholly as a mechanical driving linkage mechanically driven by the distributor and extending therefrom to the bracket for imparting a predetermined quantum of cyclic oscillatory travel to the barrel means for every cycle of rotation of the distributor, whereby to propel through the barrel means, during the quantum of cyclic oscillatory motion thereof established through the driving linkage, a number of objects equal to the number thereof fed from the distributor during a single rotational cycle thereof.

2. In a device for the propulsion of spherical objects, the improvement of claim 1 wherein said last named means includes a rotary member having a driving connection with the distributor effective to rotate said member in response to rotation of the distributor, and a link having a slidable pivotal connection to said member and extending between the member and said bracket.

3. In a device for the propulsion of spherical objects, the improvement of claim 2 wherein the connection of the link to said member is adjustable radially of the axis of rotation of said member.

4. In a device for the propulsion of spherical objects, the improvement of claim 3 wherein one of said member and link has a slot and the other has a series of openings disposed different distances from the axis of rotation of said member, each of said openings being selectively registrable with the slot, and a pin removably extended through the selected opening and slot to connect the link and said member.

5. In a device for the propulsion of spherical objects, the improvement of claim 1, wherein said motion-translating means includes a shaft rotatable with the distributor, a member rotatably driven by the shaft and having a plurality of openings located at different radial distances from the axis of rotation of the member, a link having a slot at one end extending over the member and connected at its other end to the bracket, and a drop pin extendable through the slot and a selected one of said openings.

6. In a device for the propulsion of spherical objects, the improvement as in claim 5 wherein said member and distributor are connected in a one-to-one driving ratio for effecting a single oscillation of the bracket in response to each rotational cycle of the distributor.

7. In a device for the propulsion of spherical objects, the improvement of claim 1 wherein the barrel means is mounted upon the support bracket for pivotal adjustment about a horizontal axis, said bracket being U-shaped to include side wall at opposite sides of the receiver and a back wall, said bracket mounting means comprising a pin extending from the housing and upon which the bracket is pivotally supported.

8. In a device for the propulsion of spherical objects, the improvement of claim 7 wherein the motion-translating means comprises a link extending forwardly from the support bracket below the barrel means and having one end formed as a tongue embraced by and connected to the respective side walls of the bracket, said link at its other end having a longitudinal slot, the motion-translating means further including a rotary member having an opening, said means for driving the distributor also having a driving connection with the member for simultaneous rotation of the member and distributor, and a drop pin removably engaged in said slot and said opening of the member.

9. In a device for the propulsion of spherical objects, the improvement as in claim 8 wherein the member has additional openings, all of the openings of the member being at different radial distances from the axis of rotation thereof and said drop pin being engageable in any selected one of the openings for adjusting the extent of oscillatory motion imparted to the support bracket by the link on each rotation of the disc.

10. In a propulsion device for spherical objects, said device being of the type including a rotary distributor having a series of angularly spaced object-receiving openings, a conduit having an inlet adjacent the distributor and a discharge end from which said objects are propelled, and means for rotating the distributor to register each of its openings in successively following order over said inlet for passage of a plurality of said objects in succession through the conduit to be discharged therefrom during each cycle of rotation of the distributor, an improvement for programming a cyclic oscillatory motion of the discharge end of the conduit as a wholly mechanical function of 360° rotational cycles of the distributor, the improvement comprising:

(a) means mounting the conduit for oscillation of the discharge end thereof about an axis having a vertical component; and (b) a motion-translating means in the form of a mechanical driving connection mechanically driven by the distributor and extending between the distributor and the conduit mounting means for the discharge end of the conduit in response to rotation of the distributor, in a predetermined relationship such that the discharge end of the conduit will travel through a predetermined quantum of its cyclic oscillatory motion, during a single rotational cycle of the distributor in which all the openings thereof will be registered over said inlet, for discharging through said end of the conduit, during the extent of cyclic oscillation permitted during each full rotation of the distributor, a number of objects corresponding to the number of openings registered with the conduit inlet during said 360° rotational cycle of the distributor.

11. In a device for the propulsion of spherical objects, the improvement of claim 10 wherein said motion translating means includes a rotary member mounted for angular adjustment in respect to the axis of rotation of the distributor and adapted when so adjusted to correspondingly adjust the locations at which said discharge end of the conduit is disposed along said path of oscillation thereof at the times the objects are discharged therefrom.

12. In a device for the propulsion of spherical objects, the improvement of claim 11 in which the motion translating means further includes a series of pivotal connection points in the rotary member spaced different radial distances from its axis of rotation, and a link connectable between a selected one of said points and said conduit mounting means for translating rotary motion of said member to oscillating motion of the conduit mounting means, said series of pivotal connection points comprising means that adjusts the angular extent of the path of oscillation of the discharge end of the conduit during each oscillatory cycle thereof, and that cooperates with the angular adjustment of the rotary member to variably program the discharge of the objects in respect to the relative spacing of the locations to which said objects will be propelled upon discharge from the conduit.

* * * * *